US005796057A

United States Patent [19]

Nakajima et al.

[11] Patent Number: 5,796,057

[45] Date of Patent: Aug. 18, 1998

[54] ROCKER-TYPE ELECTRICAL SWITCH

[75] Inventors: Akira Nakajima; Norio Sekine, both of Saitama, Japan

[73] Assignee: Toyodenso Kabushiki Kaisha, Tokyo, Japan

[21] Appl. No.: 706,701

[22] Filed: Sep. 6, 1996

[30] Foreign Application Priority Data

Sep. 8, 1995 [JP] Japan ..... 7-231838

[51] Int. Cl.[6] ..... H01H 3/20

[52] U.S. Cl. ..... 200/6 B; 200/339; 200/553; 200/556

[58] Field of Search ..... 200/6 B, 6 BA, 200/6 BB, 6 C, 284, 283, 553, 556, 557, 558, 559, 339, 568

[56] References Cited

U.S. PATENT DOCUMENTS 4,495,387 1/1985 Thrush ..... 200/6 B
4,540,859 9/1985 Lemmer ..... 200/6 B
5,285,039 2/1994 Satoh ..... 200/563
5,293,507 3/1994 Hayakawa ..... 200/244
5,382,768 1/1995 Kurek et al. ..... 200/556
5,500,498 3/1996 Kurek et al. ..... 200/556

*Primary Examiner*—Adolf Berhane
*Attorney, Agent, or Firm*—Birch, Stewart, Kolasch, and Birch, LLP

[57] ABSTRACT

A rocking member is swingably supported on one opening side of a cylindrical case, and a knob is attached to the rocking member. The rocking member is provided with a rocking arm extending therefrom in the longitudinal direction of the case. The rocking arm has a tip section for engaging projections of a contact holder. The contact holder is moved in a direction perpendicular to the longitudinal direction of the case by the swinging action of the rocking arm, thereby switching a plurality of circuits. As a result, the switch can be made compact and its structure can be simplified.

20 Claims, 7 Drawing Sheets

ROCKER-TYPE ELECTRICAL SWITCH

BACKGROUND OF THE INVENTION

1. Field of the Invention

This invention relates to an electrical rocker switch in which a plurality of circuits may be switched by causing a knob to swing.

2. Description of the Prior Art

A switch is generally known which comprises a cylindrical case, a board accommodated in the case, a push button depressibly mounted on one end of the case, and a contact holder adapted to interlock with the push button to move in the longitudinal direction of the case, wherein a plurality of circuits are switched by moving the contact holder on the board.

In such a conventional push button switch, a special cam mechanism is needed when the contact holder is moved to switch a plurality of circuits, and this complicates the structure. Also, since the movement of the contact holder corresponds to the longitudinal direction of the case, there is a drawback that the case becomes long and the switch cannot be made compact.

The present invention was made in order to solve the above-mentioned problems of the prior art by providing an improved rocker switch.

SUMMARY OF THE INVENTION

According to the present invention, a switch is provided which comprises a cylindrical case, a knob swingably supported on one end of the case, and a contact holder adapted to interlock with the swing of the knob to move in a direction perpendicular to the longitudinal direction of the case, thereby switching a plurality of circuits.

With the structure described above, the length of the case may be shortened in spite of the provision of a plurality of circuits, and thus the switch itself may be made compact.

The switch may also be provided with a rocking member for connecting the knob to the contact holder, and a stabilizing mechanism for stabilizing the rocking member, wherein the stabilizing member may be provided with an engaging groove and a coil spring for biasing a ball into the engaging groove.

The switch is thus different from the conventional push button switch and its positioning can be controlled by the sliding balance between the stabilizing mechanism and the contact holder. With this structure, a complicated switching mechanism such as a heart-shaped cam is no longer needed and the switch structure can be simplified.

Further, the contact holder may be provided with a pair of projections for holding the tip of the rocking member therebetween.

By this structure, the tip of the rocking member can be firmly connected to the contact holder and the rocking member can be arranged so as not to affect the movement of the contact holder.

A rectangular holder accommodating recess may also be provided to movably receive the contact holder in the direction perpendicular to the longitudinal direction of the case.

With this structure, the movement of the contact holder can be smoothly effected.

Further, the contact holder may be provided with a movable contact and a contact spring for biasing this movable contact to the side of a board.

Consequently, the movable contact can be caused firmly to slide on the board and a contact fault can be avoided.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENT

An embodiment of the present invention will be described in detail with reference to the drawings attached hereto.

Figure 3:
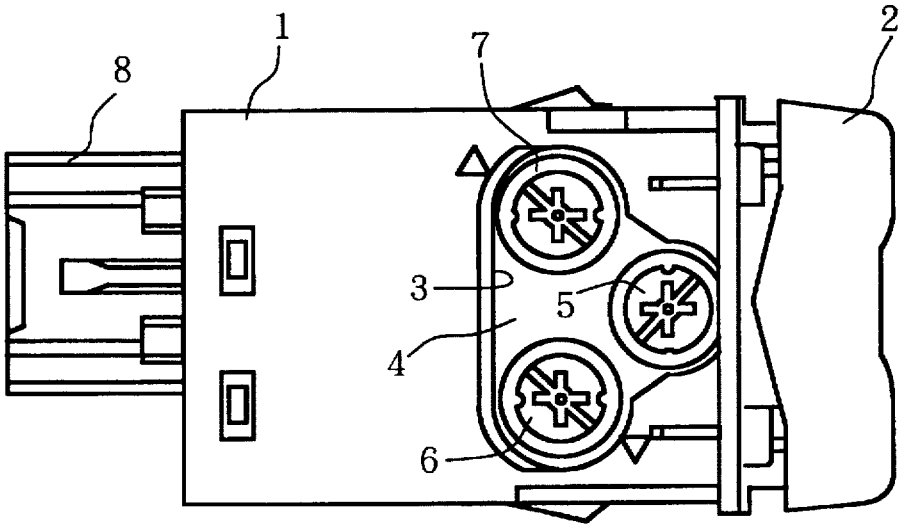
FIG. 3 is a view of the right side of the switch.

In these drawings, this switch is provided with a cylindrical case 1 and a knob 2 swingably supported on the side of one opening section of the case 1. The case 1 is also provided with a generally triangular hole 3 formed in one side (see FIG. 3).

Three bulbs 5, 6 and 7 are detachably mounted through this hole 3 on a board 4 which is accommodated within the case 1.

Extending from the other side of the case 1 is a coupler 8 which is integrally formed with the board 4.

Figure 1:
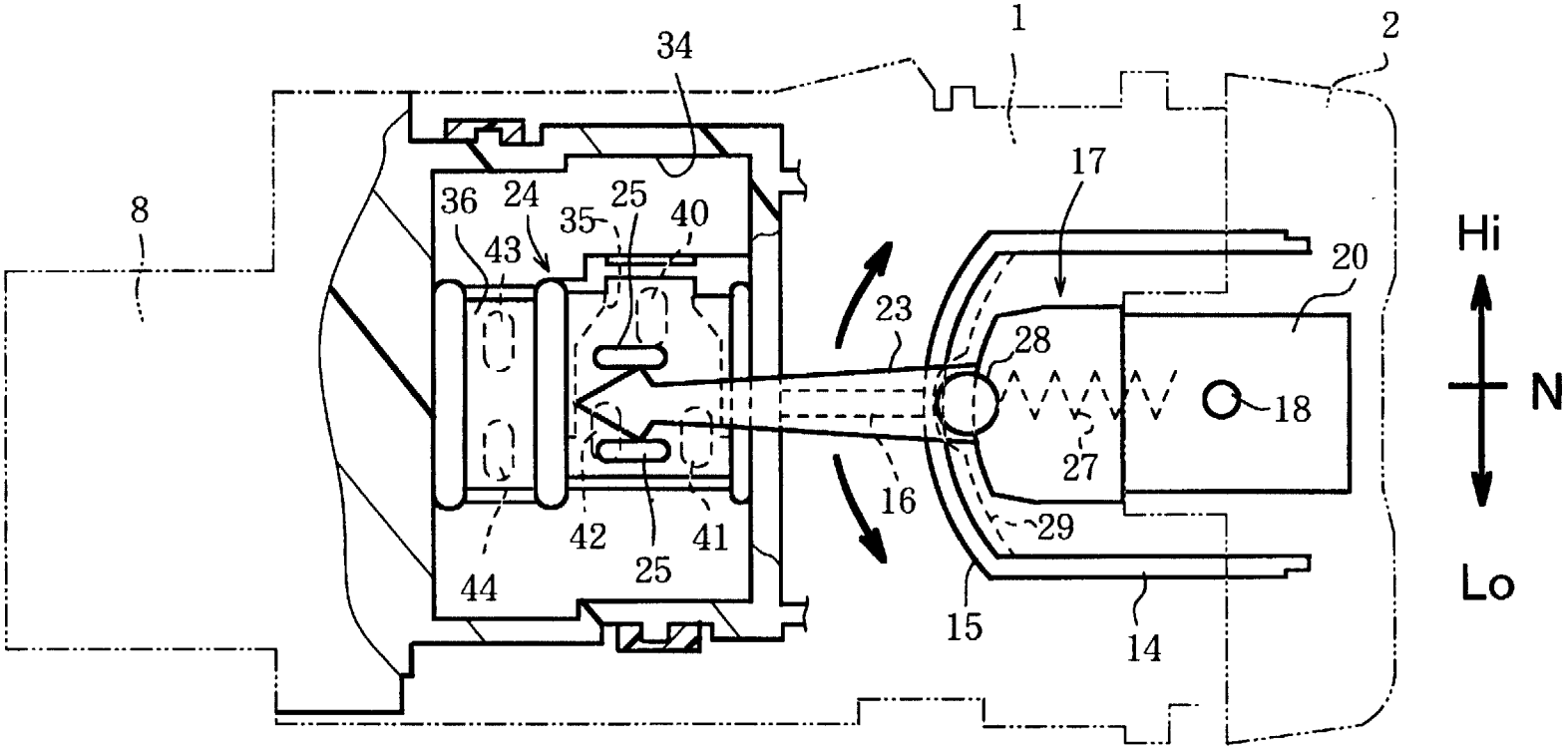
FIG. 1 is a view showing internal components of a switch.
Figure 2:
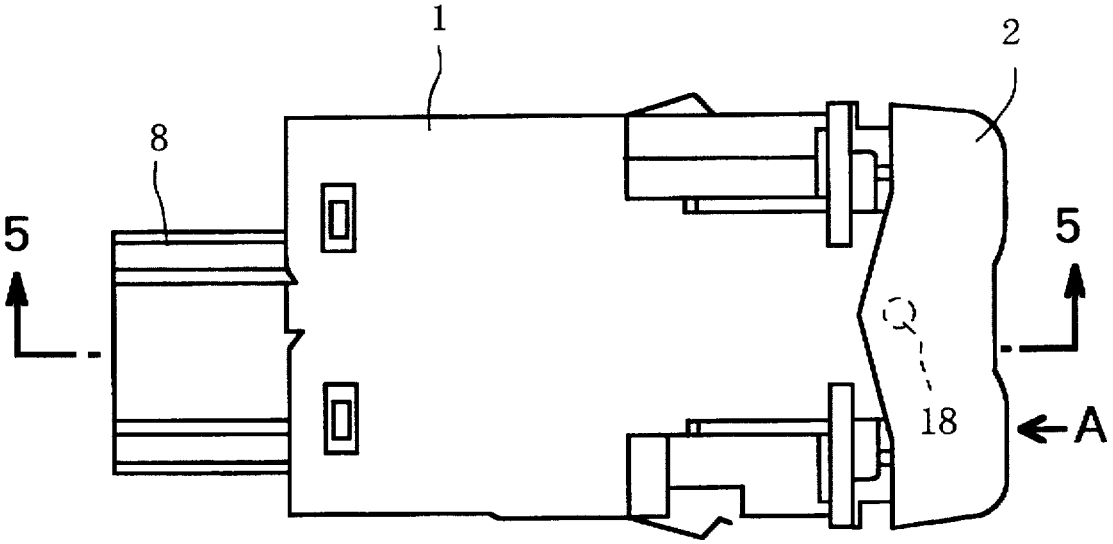
FIG. 2 is a view of the left side of the switch.
Figure 4:
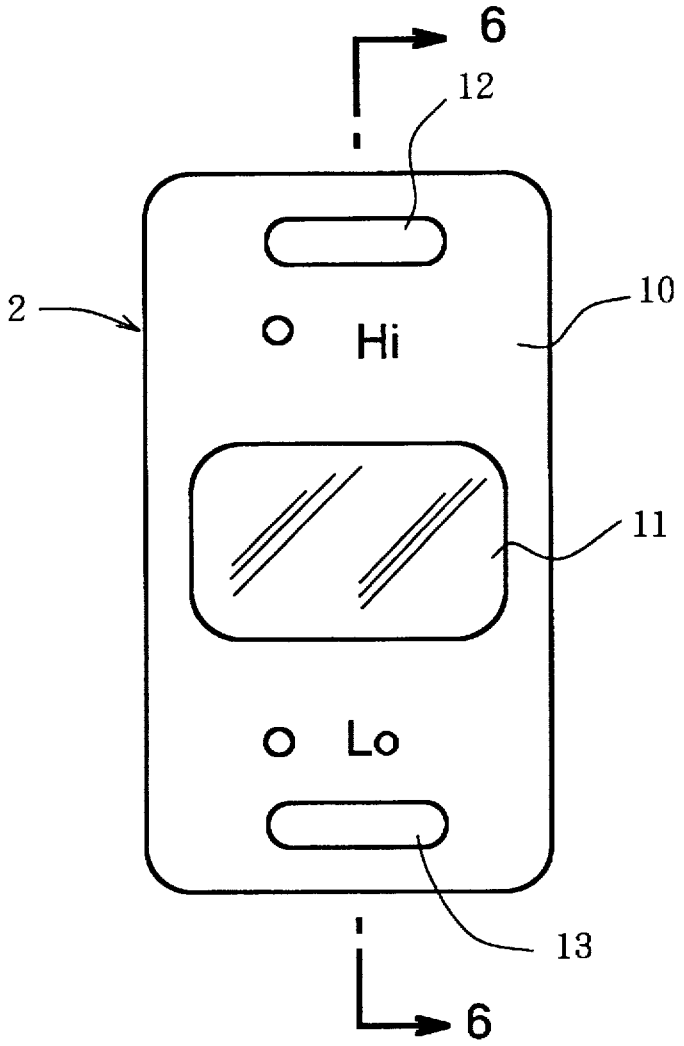
FIG. 4 is a view of a knob in the direction shown by an arrow A in FIG. 2.

As best shown in FIG. 1, the knob 2 can be swung in a seesawing or rocking manner to the higher side (Hi) or to the lower side (Lo) from its central position N, and is provided on its operating surface 10 with a central lens 11, an upper lens 12 and a lower lens 13, respectively, as shown in FIG. 4.

The bulb 5 serves as a pilot lamp and when lit, the light is transmitted through the central lens 11. The lens 12 indicates the lighting of the bulb 6 when the knob 2 is caused to swing to the Hi side, while the lens 13 indicates the lighting of the bulb 7 when the knob 2 is caused to swing to the Lo side.

Figure 5:
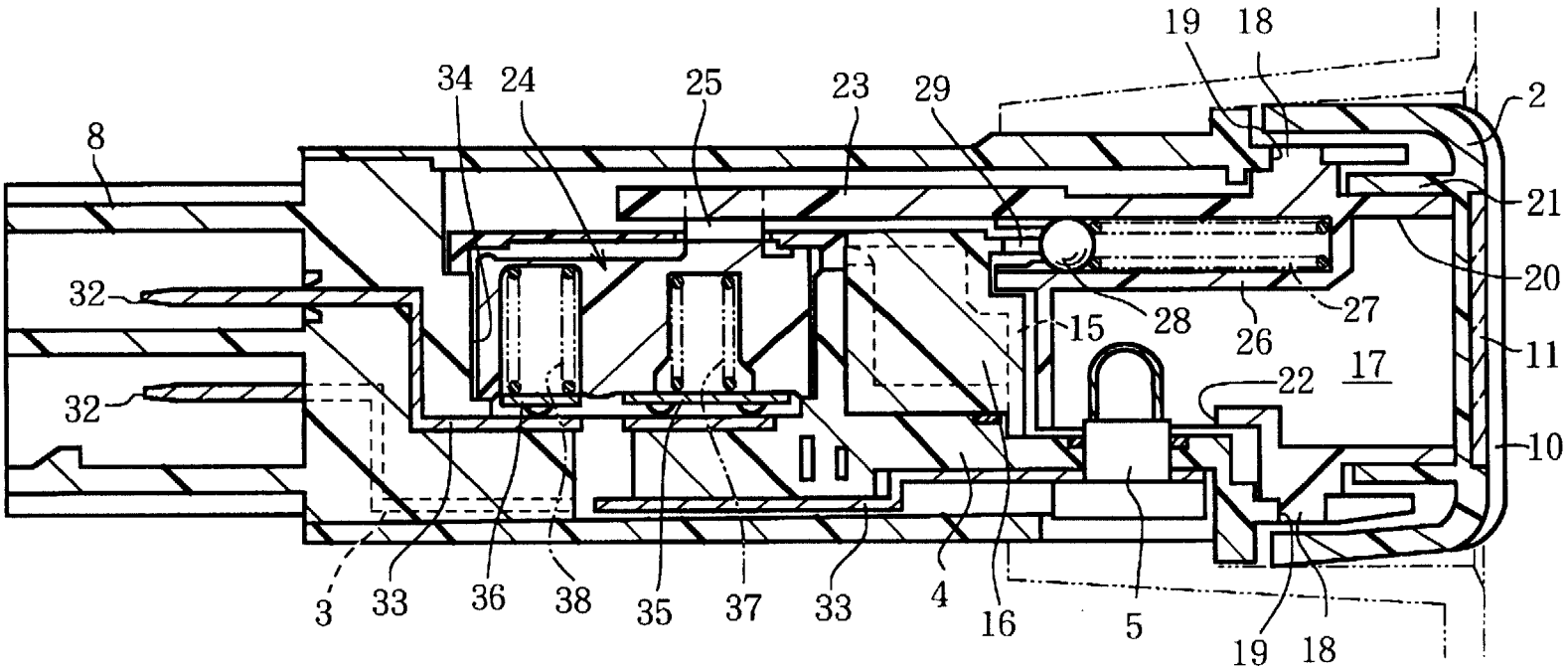
FIG. 5 is a cross-sectional view taken along the line 5—5 of FIG. 2.
Figure 6:
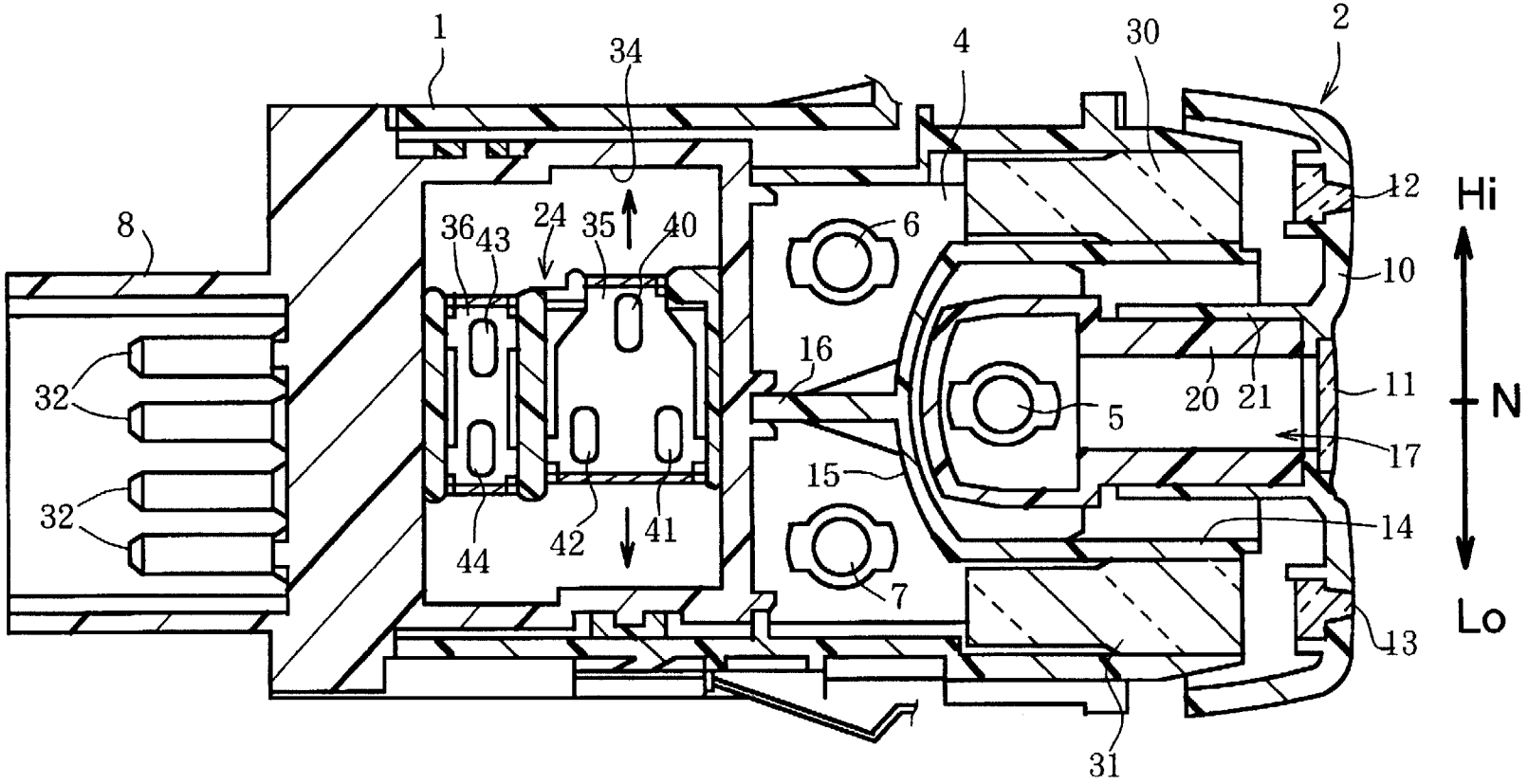
FIG. 6 is a cross-sectional view taken along the line 6—6 of FIG. 4.

As shown in FIGS. 1, 5 and 6, a guide section 14 of a generally U-shaped wall is formed on the inside of the case 1 from its central section to the side of the knob 2. The guide section 14 has a partially arc-shaped bottom section 15. The bulbs 5, 6 and 7 are isolated from one other by the guide section 14 and a partition 16 extending from the center of the bottom section 15 to the inside of the case 1.

A rocking member 17 is accommodated inside of the guide section 14 and projections 18 are integrally formed with both end walls of the rocking member 17. The projections 18 engage holes 19 formed in the side surface of the case 1 (FIG. 5) so that the rocking member 17 can swing about the projections 18 relative to the case 1.

The rocking member 17 is provided with a cylindrical neck section 20, the periphery of which is adapted to engage a cylindrical section 21 extending inwardly from the central section of the knob 2 (FIG. 6) so that the knob 2 and the rocking member 17 can swing together.

The bulb 5 projects through a side hole 22 inside the rocking member 17 (FIG. 5) and the light from the bulb 5 passes through a space in the neck section 20 and is emitted from the central lens 11.

Further, as is apparent from FIGS. 1 and 5, the rocking member 17 is provided, within the case 1, with a rocking arm 23 integrally formed therewith and extending in the longitudinal direction of the case 1 along the surface side of the case 1. The tip of the rocking arm 23 is inserted between a pair of projections 25 projecting parallel to the surface of the contact holder 24.

A spring holder 26 is provided to extend in the longitudinal direction of the case 1 along the rocking arm 23 (FIG. 5). A coil spring 27 and a ball 28 pressing against the end of the coil spring 27 are accommodated in the spring holder 26. A stabilizing mechanism is thus formed by causing the ball 28 to engage with an engaging groove 29 which is formed at the bottom 15 of the guide section 14 and has the same arc-shape as the bottom 15.

As is apparent in FIG. 6, the bulb accommodating space within the case 1 is divided into three sections by the guide section 14 and the partition 16. The bulb 6 is accommodated in the space defined by one side of the partition 16 and the light when lit is transmitted to the upper lens 12 through a light transmittable member 30.

On the other hand, the bulb 7 is accommodated in the space defined by the other side of the partition 16 and the light when lit is transmitted to the lower lens 13 through a light transmittable member 31.

As shown in FIG. 5, a plurality of conductive plates 33 serving as coupler terminals 32 by the projection of one end of each conductive plate 33 into the coupler 8 is embedded in the board 4. The board 4 has an area adapted to serve as a bulb attaching section between its central section and the knob side section, and also has a rectangular holder accommodating recess 34 formed on the side of the coupler 8.

Figure 8:
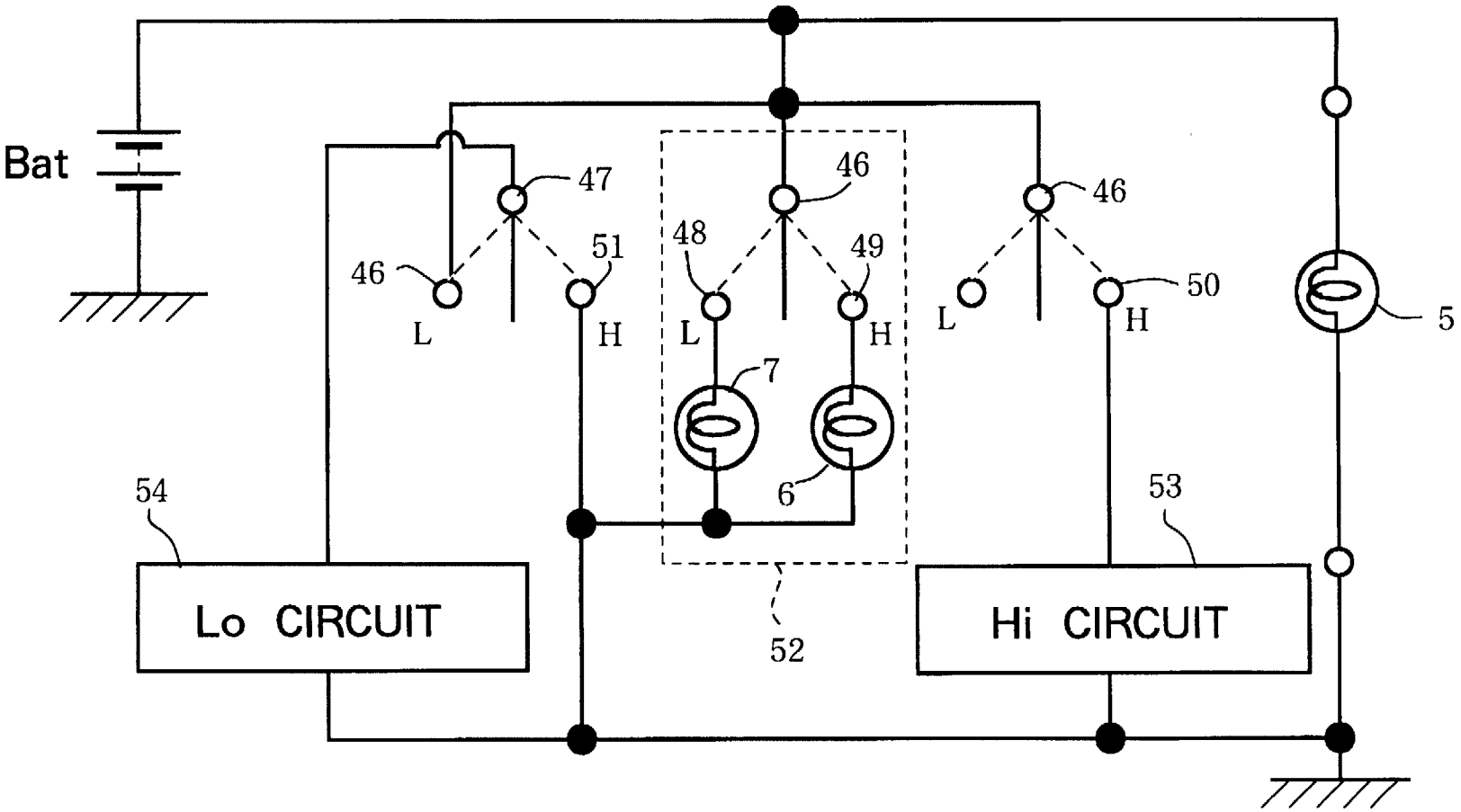
FIG. 8 is a circuit diagram.

Exposed within this holder accommodation recess 34 is a part of each conductive plate 33 which serves as a stationary contact described below (FIG. 8).

A contact holder 24 is disposed in the holder accommodation recess 34 to move in a direction perpendicular to the longitudinal direction of the case 1 as a result of the swinging motion of the rocking arm 23.

The contact holder 24 is provided with two independent movable contact plates, i.e. a first movable contact plate 35 and a second movable contact plate 36 which are pressed and energized by contact springs 37 and 38 (FIG. 5) to the side of the board 4, respectively.

Figure 7:
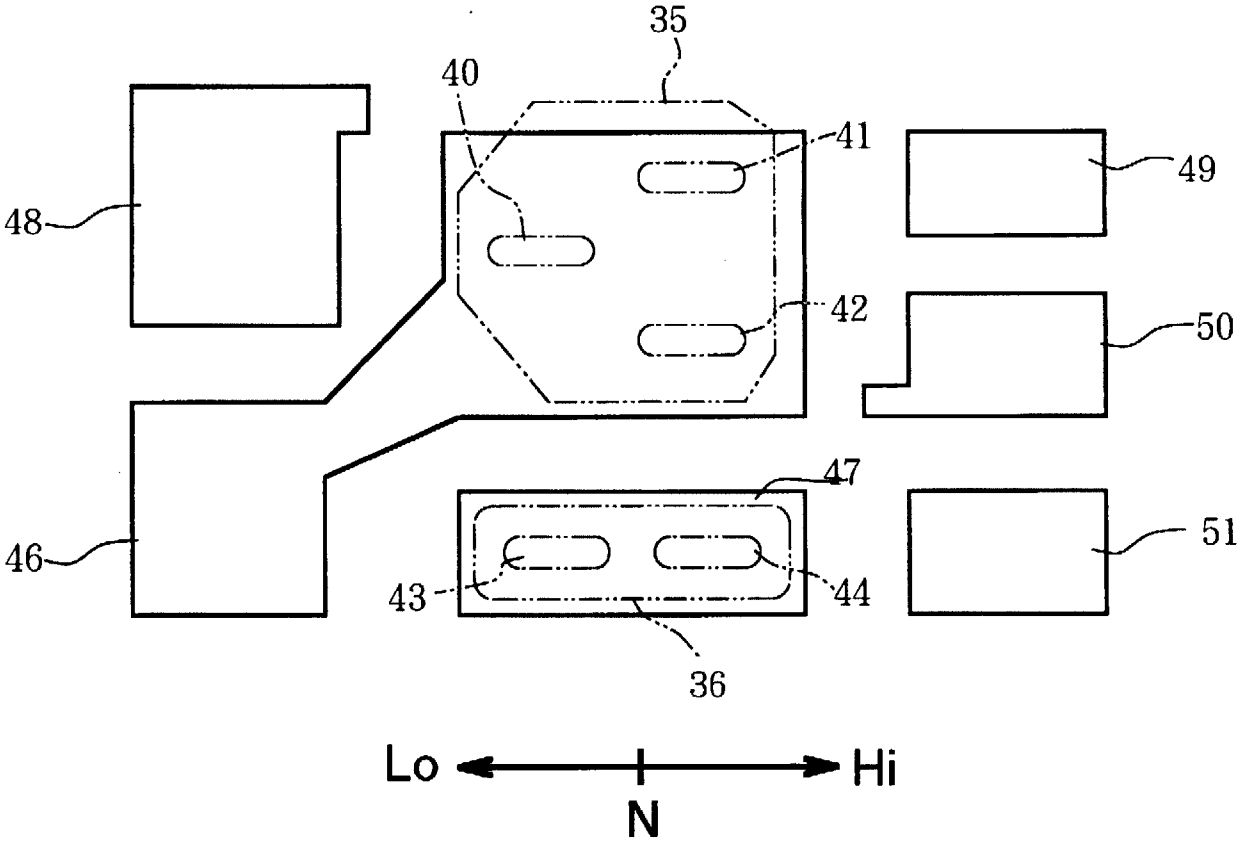
FIG. 7 is a view showing contacts.

As shown in FIG. 7, the first movable contact plate 35 has three movable contacts of first through third movable contacts 40, 41 and 42, while the second movable contact plate 36 has two movable contacts of a fourth movable contact 43 and a fifth movable contact 44, respectively.

In the neutral position N of FIG. 7, the three movable contacts 40, 41 and 42 of the first movable contact plate 35 are on the first stationary contact 46, while the second movable contact plate 36 is on the second stationary contact 47.

Referring to the lower position Lo, the first movable contact plate 35 is moved to the left side of the drawing to conduct electricity between the third stationary contact 48 and the first stationary contact 46, and the second movable contact plate 36 also conducts electricity between the first stationary contact 46 and the second stationary contact 47.

In the higher position Hi, the first movable contact plate 35 is moved to the right side of the drawing to conduct electricity between the first stationary contact 46 and the fourth and fifth stationary contacts 49 and 50, while the second movable contact plate 36 likewise conducts electricity between the second stationary contact 47 and the sixth stationary contact 51.

FIG. 8 shows a circuit diagram indicating the operation of this switch. Three circuits are provided, specifically a bulb circuit 52, a higher side circuit Hi 53 and a lower side circuit Lo 54. The bulb circuit 52 is a circuit for switching the bulbs 6 and 7. The Hi circuit 53 puts an electric apparatus in a Hi side state. The Lo circuit 54 puts the electric apparatus in a Lo side state. It is to be noted that the bulb 5 is always lit as a pilot lamp irrespective of the switching operation.

The operation of the switch will now be described. In FIG. 1, when the case 1 is in the neutral position N, the contact holder 24 is also in the neutral position in which each of the circuits 52, 53 and 54 is not operative and only the bulb 5 lights.

When the knob 2 is moved to the Hi side, the rocking arm 23 is swung in the counterclockwise direction in FIG. 1 to move the contact holder 24 downward in the drawing in a direction perpendicular to the longitudinal direction of the case 1.

As a result, the contact state in the Hi side position of FIG. 7 is obtained and in the circuits shown in FIG. 8, the bulb 6 lights in the bulb circuit 52 and the Hi side circuit 53 is switched on.

Conversely, if the knob 2 is moved to the Lo side, the rocking arm 23 is swung clockwise in FIG. 1 to swing the contact holder 24 upward in the drawing so that the contact state in the Lo side of FIG. 7 is obtained.

Consequently, in the circuits shown in FIG. 8, the bulb 7 lights in the bulb circuit 52 and the Lo side circuit 54 is switched on.

Thus, since the knob 2 is swingably disposed and the contact holder 24 is arranged to move in the direction perpendicular to the longitudinal direction of the case 1, the length of the case 1 can be shortened in spite of the provision of a plurality of circuits and as a result, the switch itself can be made compact.

Further, since a swingable knob has been adopted which is different from the conventional push-button type switch and its positioning can be controlled by the sliding balance between the stabilizing mechanism and the contact holder 24, a complicated switching mechanism such as a heart-shaped cam is not needed and the structure can be simplified.

The switch according to the present invention is arranged so that the knob is swingably supported at one end of the cylindrical case and the contact holder adapted to interlock with the knob is moved in the direction perpendicular to the longitudinal direction of the case. Thus, the length of the case can be shortened in spite of the provision of a plurality of circuits and as a result, the switch itself can be made compact.

Further, since the present switch is different from the conventional push-button type switch in that the swingable knob is adopted, the positioning of the switch can be controlled by the most orthodox click mechanism, a complicated switching mechanism such as a heart-shaped cam is not needed and the structure can be simplified.

The invention being thus described, it will be obvious that the same may be varied in many ways. Such variations are not to be regarded as a departure from the spirit and scope of the invention, and all such modifications as would be obvious to one skilled in the art were intended to be included within the scope of the following claims.

What is claimed is:

1. An electrical rocker switch comprising:

a cylindrical case;

a knob swingably supported at one end of the case;

a movable contact holder adapted to interlock with swinging action of the knob to move in a direction perpendicular to a longitudinal direction of the case, the contact holder including a plurality of movable contacts for switching a plurality of circuits;

board provided with a plurality of stationary contacts to contact with the movable contacts;

a rocking member provided within said case for connecting the knob to the contact holder, said rocking member including a rocking arm integrally formed therewith and extending in the longitudinal direction of the case adjacent an inside surface of the case, with a tip of the rocking arm engaging the contact holder; and a stabilizing mechanism located between the knob and the contact holder for stabilizing the rocking member, said stabilizing mechanism including an engaging groove formed in a portion of the case, a ball movable along the engaging groove, and a coil spring for biasing the ball into the engaging groove.

2. The electrical rocker switch according to claim 1, wherein the contact holder is provided with a pair of projections for holding the tip of the rocking arm therebetween.

3. The electrical rocker switch according to claim 1, wherein a rectangular holder accommodating recess is provided in the board so that the contact holder can be accommodated therein to move in a direction perpendicular to the longitudinal direction of the case.

4. The electrical rocker switch according to claim 1, wherein the contact holder is provided with contact springs for biasing the movable contacts toward the board.

5. The electrical rocker switch according to claim 1, wherein said case further comprising a generally U-shaped wall therein having an arc-shaped bottom section, said engaging groove being located on said bottom section.

6. The electrical rocker switch according to claim 1, further comprising a plurality of lights located in said case, one of said lights illuminating said knob, and remaining ones of said lights illuminating when said knob is depressed.

7. The electrical rocker switch according to claim 1, wherein said knob is movable between a first position where an upper portion of the knob is depressed and a first electrical circuit is completed, a second intermediate neutral position, and a third position where a lower portion of the knob is depressed and a second electrical circuit is completed.

8. The electrical rocker switch according to claim 7, further comprising a plurality of lights located in said case, a first one of said lights illuminating said knob, a second one of said lights illuminating when said knob is in said first position, and a third one of said lights illuminating when said knob is in said third position.

9. The electrical rocker switch according to claim 8, wherein said case further comprising a generally U-shaped wall member therein having an arc-shaped bottom section with a partition member extending outwardly therefrom, said U-shaped wall member and said partition member isolating the lights from one another.

10. The electrical rocker switch according to claim 8, wherein said knob includes a pair of lenses for allowing light emitted from said first and third lights to pass therethrough.

11. The electrical rocker switch according to claim 10, wherein said switch further includes a pair of light transmitting members for transmitting light emitted from said first and third lights to said lenses.

12. The electrical rocker switch according to claim 1, further comprising at least one light attached to said rocking member for illuminating said knob.

13. The electrical rocker switch according to claim 12, wherein said knob includes a lens for allowing light emitted from said light to pass therethrough.

14. The electrical rocker switch according to claim 1, wherein said plurality of movable contacts includes first and second electrically isolated movable contact plates.

15. The electrical rocker switch according to claim 14, wherein said plurality of stationary contacts includes first, second, third, fourth, fifth and sixth electrically isolated stationary contact plates.

16. The electrical rocker switch according to claim 15, wherein said knob is movable to a first position where an upper portion of the knob is depressed and said first movable contact plate connects said first stationary contact with said fourth and said fifth stationary contact plates, and said second movable contact plate connects said second stationary contact plate with said sixth stationary contact plate.

17. The electrical rocker switch according to claim 15, wherein said knob is movable to a second position where a lower portion of the knob is depressed and said first movable contact plate connects said first stationary contact with said third stationary contact plate, and said second movable contact plate connects said second stationary contact plate with said first stationary contact plate.

18. The electrical rocker switch according to claim 15, wherein said knob is movable between a first position where an upper portion of the knob is depressed and a second position where a lower portion of the knob is depressed, wherein when said knob is in said first position, said first movable contact plate connects said first stationary contact with said fourth and said fifth stationary contact plates, and said second movable contact plate connects said second stationary contact plate with said sixth stationary contact plate, and wherein when said knob is in said second position, said first movable contact plate connects said first stationary contact with said third stationary contact plate, and said second movable contact plate connects said second stationary contact plate with said first stationary contact plate.

19. The electrical rocker switch according to claim 14, wherein the tip of the rocking arm is located directly above said first movable contact plate, and said tip includes opposed ear portions which engage opposed projections extending from the contact holder.

20. A switch comprising:

a cylindrical case;

a knob swingably supported at one end of the case; and a contact holder adapted to interlock with the swinging action of the knob to move in a direction perpendicular to the longitudinal direction of the case, thereby switching a plurality of circuits, wherein a rocking member for connecting the knob to the contact holder and an energizing mechanism for energizing the rocking member are provided, the energizing mechanism comprising an engaging groove and a coil spring for energizing a ball into the engaging groove.

* * * * *